US008490592B1

(12) United States Patent
Von Tiergen

(10) Patent No.: US 8,490,592 B1
(45) Date of Patent: Jul. 23, 2013

(54) REMOVABLE TORQUE TRANSFER STARTER FOR ENGINE

(71) Applicant: Eric G. Von Tiergen, Cayman Islands (KY)

(72) Inventor: Eric G. Von Tiergen, Cayman Islands (KY)

( * ) Notice: Subject to any disclaimer, the term of this patent is extended or adjusted under 35 U.S.C. 154(b) by 0 days.

(21) Appl. No.: 13/666,425

(22) Filed: Nov. 1, 2012

(51) Int. Cl.
*F02N 11/00* (2006.01)

(52) U.S. Cl.
USPC ..... 123/179.25; 74/6

(58) Field of Classification Search
USPC ..... 123/179.3, 179.28, 179.25, 179.24, 123/179.1, 185.1; 74/6
See application file for complete search history.

(56) References Cited

U.S. PATENT DOCUMENTS

| | | | | | |
|---|---|---|---|---|---|
| 2,901,911 | A * | 9/1959 | Duncan | 74/7 R |
| 3,331,363 | A * | 7/1967 | Holton, Jr. | 123/179.26 |
| 3,437,083 | A * | 4/1969 | Hamman | 123/179.26 |
| 3,537,436 | A | 11/1970 | Heisler | |
| 3,596,647 | A * | 8/1971 | Heisler | 123/179.26 |
| 3,791,225 | A * | 2/1974 | Molliet | 74/7 R |
| 3,885,544 | A * | 5/1975 | Pfeiffer | 123/179.26 |
| 4,365,596 | A * | 12/1982 | Bennett, Sr. | 123/179.26 |
| 4,372,263 | A | 2/1983 | Costa | |
| 4,569,315 | A | 2/1986 | Bodnar | |
| 5,345,900 | A * | 9/1994 | Wisegerber | 123/179.24 |
| 6,253,722 | B1 | 7/2001 | Robinson et al. | |
| 7,331,321 | B2 * | 2/2008 | Thompson | 123/179.24 |
| 7,530,340 | B1 * | 5/2009 | Jellinek et al. | 123/179.25 |
| 7,748,360 | B2 * | 7/2010 | Thompson | 123/185.3 |
| 2011/0126790 | A1 * | 6/2011 | Vacek | 123/179.28 |

* cited by examiner

*Primary Examiner* — Hai Huynh

(57) ABSTRACT

A removable torque transfer starter for engine that includes a housing releasably attachable to an engine, wherein torque is transferred to a crank axle of the engine internally relative the housing, whereby an operator need not apply an external torque to start the internal combustion engine, but may depress a start button and securely support the device being started instead.

8 Claims, 2 Drawing Sheets

REMOVABLE TORQUE TRANSFER STARTER FOR ENGINE

BACKGROUND OF THE INVENTION

Various types of removable torque transfer starters for engines are known in the prior art. However, what is needed is a removable torque transfer starter for engine that includes a housing releasably attachable to an engine, wherein torque is transferred to a crank axle of the engine internally relative the housing, whereby an operator need not apply an external torque to start the internal combustion engine, but may depress a start button and securely support the device being started. The purpose of the present invention is to remove the necessity of an internal starter and battery from various internal combustion devices to alleviate the weight penalty, bulk, and other factors.

FIELD OF THE INVENTION

The present invention relates to a removable torque transfer starter for engine, and more particularly, to a removable torque transfer starter for engine that includes a housing releasably attachable to an engine, wherein torque is transferred to a crank axle of the engine internally relative the housing, whereby an operator need not apply an external torque to start the internal combustion engine, but may depress a start button and securely support the device being started.

SUMMARY OF THE INVENTION

The general purpose of the removable torque transfer starter for engine, described subsequently in greater detail, is to provide a removable torque transfer starter for engine which has many novel features that result in a removable torque transfer starter for engine which is not anticipated, rendered obvious, suggested, or even implied by prior art, either alone or in combination thereof.

When operating handheld power tools and machinery driven by means of an internal combustion engine, the need to manually start such engines can be tiresome and oftentimes unwieldy, even frustrating. When using such tools over extended periods or spaces, these problems may be amplified. It is also possible to render a device inoperable by wearing out the rope completely, snapping the rope, or stripping the starting mechanism with continued, unsuccessful attempts to start an internal combustion engine manually. Locating an internal starter within such devices renders said devices too large and heavy for comfortable usage. Wherefore, an improved, attachable starting mechanism is warranted to obviate these and other problems resulting from the manual starting of internal combustion engines.

Many devices usable to transfer torque to start an internal combustion engine are seen in the prior art. However, most of these are handheld devices, to which an opposing centripetal force must be externally applied during use, which force necessarily requires exertion and steadfastness by the operator. Such needed force engenders risk as a user must firmly support the handheld device while initiating the transfer of torque to the internal combustion engine, wherefore may result a lesser grip upon the internal combustion engine. Should the internal combustion engine then fire, a dangerous condition may result as the device driven by the internal combustion engine runs free of the operator. Moreover, the sudden jolt accorded the operator when activating the torque transfer may cause instability of the operator himself, move the operator into an unsafe situation relative the internal combustion engine being started, or careen the handheld device off of the engine to which said handheld device is being applied, causing hazards to the operator and those around him.

The present device, therefore, has been devised to releasably attach to an internal combustion engine of an extant device such as a lawn mower or chainsaw. The device releasably attaches directly to the engine so that torque administered to the crank axle of said engine is distributed through the housing internally with reference to the device. Because the device is releasably attached directly to the engine itself, the opposite force engendered by the application of torque is resisted at the housing, and the torque is efficiently distributed to the crank axle of the engine without the risk of the device careening out of contact with the crank axle, as often occurs with handheld devices applied for the same purpose. Moreover, no opposing centripetal force need be applied externally to the device, as is required with handheld devices devised for a similar purpose. Thus, the present device lessens accidents resultant from a person applying centripetal force to maintain a device in place when transferring torque from a handheld starter to an internal combustion engine.

The present device, therefore, includes a housing releasably attachable to an internal combustion engine. The housing includes an anterior face, configured to contact the engine, and a posterior face. The housing releasably connects to the engine and a socket, disposed within the anterior face, releasably receives a crank axle of the engine therein.

An electric motor is disposed within the housing, said motor in operational communication with the socket. A ratchet assembly is disposed in operational communication with the socket whereby rotation of the socket is accorded within the rotation of the ratchet assembly. The ratchet assembly enables rotational speeds greater than those exerted by the motor to be applied to the socket without effecting the motor. Thus, when the engine to which the device is applied fires, and the crank axle is rotated faster than the rotational speeds accorded by the rotation of the socket, the motor of the device does not exert drag on the engine, rather the ratchet assembly enables rapid revolution of the socket disengaged from the motor in the manner and form typical of Bendix gears.

The electric motor is powerable by means of a rechargeable battery disposed within the housing. The battery is in circuit with a electrical port disposed on the posterior face of the housing. The electrical port is interconnectable with an external power source, and the battery rechargeable thereby. Moreover, the device is operable off an external power source independent of the battery when interconnected to an external power source by means of the electrical port. Use of the battery is thus optional for functioning of the device.

To activate and deactivate the device, a start button is disposed upon the posterior face of the housing, said start button in circuit with the battery and the motor. Upon depression of the start button, the motor is activated, and torque is transferred from the revolutions of the motor to the socket disposed in the anterior face. Because the motor is an electric motor, the force enabled by electrical induction is instantaneous, and depression of the start button instantaneously transfers torque from the motor to the crank axle to which the device is applied. It should be recognized that the situation of the start button is not considered a limitation of the device—the start button may be remotely situated in circuit with the motor and battery, if desired.

The device is simply mounted to the relevant internal combustion engine and releasably attached thereto. The start button is depressed, and the engine started. Because the device is releasably attachable to the engine, the particular handheld device to which the removable torque transfer starter for engine is applied may be grasped with both hands as the device fires, lessening the danger of a device firing without the security of a ready and firm grasp upon said particular device.

Thus has been broadly outlined the more important features of the present removable torque transfer starter for engine so that the detailed description thereof that follows may be better understood and in order that the present contribution to the art may be better appreciated.

Objects of the present removable torque transfer starter for engine, along with various novel features that characterize the invention are particularly pointed out in the claims forming a part of this disclosure. For better understanding of the removable torque transfer starter for engine, its operating advantages and specific objects attained by its uses, refer to the accompanying drawings and description.

BRIEF DESCRIPTION OF THE DRAWINGS FIGURES

DETAILED DESCRIPTION OF THE DRAWINGS

Figure 1:
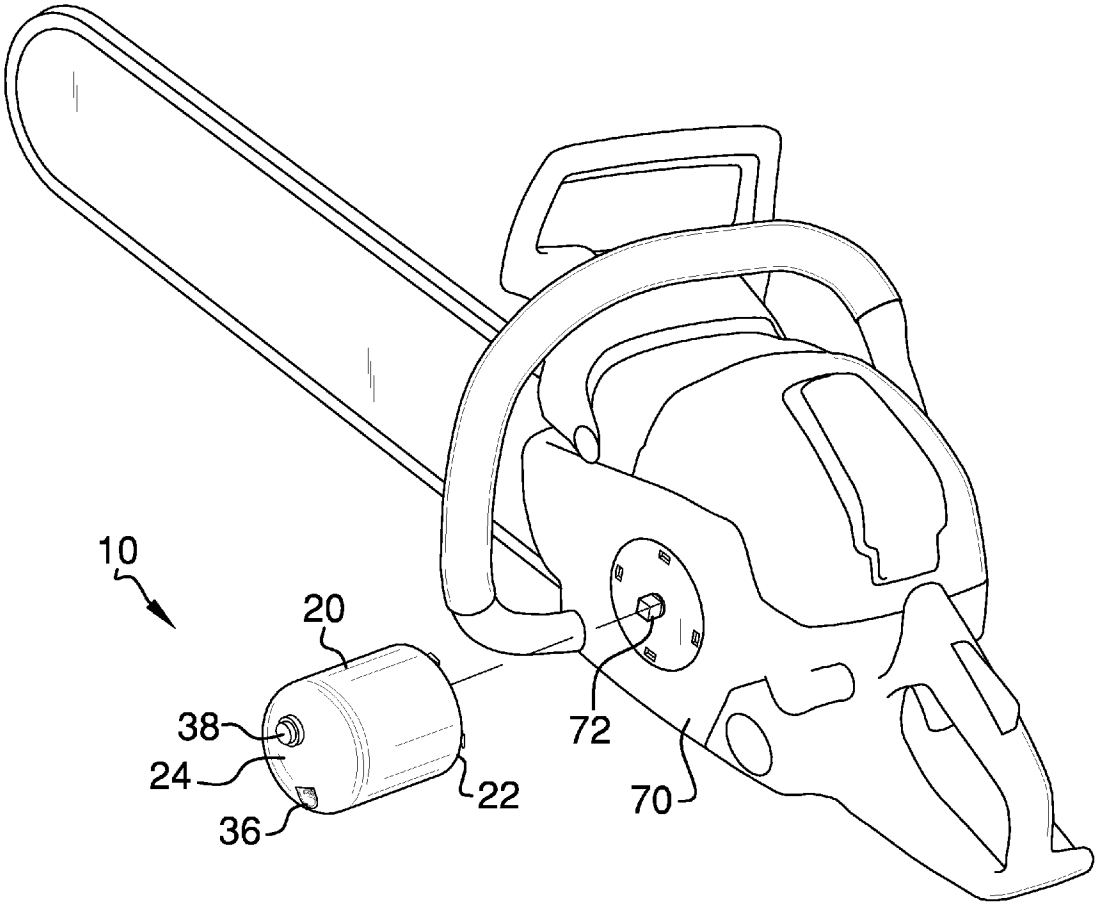
FIG. 1 is an isometric view.
Figure 2:
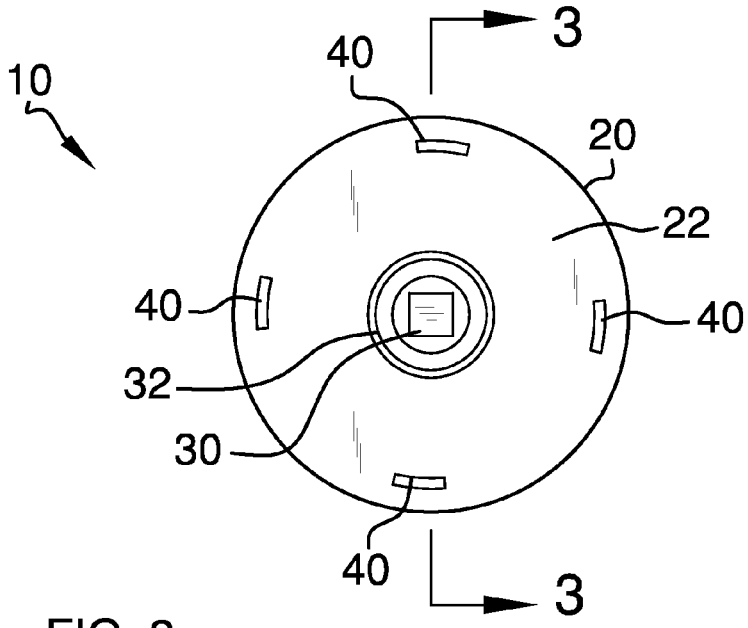
FIG. 2 is a front view of an anterior face.
Figure 3:
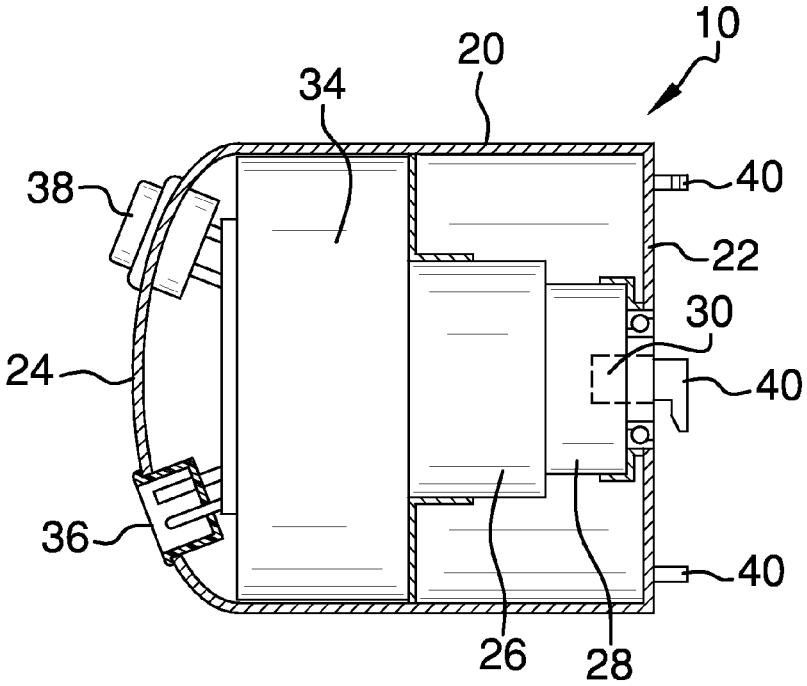
FIG. 3 is a cross-section view taken along the line 3-3 of FIG. 2.

With reference now to the drawings, and in particular FIGS. 1 through 3 thereof, example of the instant removable torque transfer starter for engine employing the principles and concepts of the present removable torque transfer starter for engine and generally designated by the reference number 10 will be described.

Referring to FIGS. 1 through 3 a preferred embodiment of the present removable torque transfer starter for engine 10 is illustrated.

The present removable torque transfer starter for engine 10 has been devised to enable rapid and ready start up of many handheld motorized tools and other combustion engines without the need of physical exertion, as is often required when pulling on a starter rope or other manual crank mechanism required to initialize torque in an engine before firing. The present removable torque transfer starter 10 also removes the necessity of an internal starter and battery from various internal combustion devices and alleviates the associated weight and bulk of said devices.

The present removable torque transfer starter for engine 10 releasably attaches to an extant internal combustion engine 70, releasably receiving an extant crank axle 72 disposed upon said engine 70 in a socket 30 disposed within an anterior face 22 of the device 10. Depression of a start button 38 disposed in circuit with the device 10 activates an electric motor 26, which torque is transferred through a ratchet assembly 28 wherein the socket 30 is rotated at a desired rate whereby the crank axle 72 is rotated and the engine 70 is startable without the need of physical exertion or manual application of torque directly to the crank axle 72. Once the engine 70 is started, the ratchet assembly 28 prevents drag being exerted upon the engine 70 in the manner typical of a Bendix gear.

The removable torque transfer starter for engine 10 therefore includes a housing 20 having an anterior face 22 and a posterior face 24. An electric motor 26 is disposed within the housing 20. A ratchet assembly 28 is disposed in the housing 20 in operational communication with the motor 26, the ratchet assembly 28 disposed proximal the anterior face 22.

A socket 30 is rotatably disposed anteriorly upon the ratchet assembly 28, said socket 30 centrally obtruded within the anterior face 22 of the housing. The socket 30 is in rotational communication with the ratchet assembly 28. A bearing 32 is volubly disposed in contact with the socket 30 to enable smooth, uninterrupted rotation of the socket 30. When the engine to which the device 10 is applied is started, the ratchet assembly 28 ensures no drag is placed on the engine 70.

A battery 34 is in electrical communication with the motor 26. A electrical port 36 is disposed in circuit with the battery 34, said electrical port 36 configured upon the posterior face 24 of the housing to releasably interconnect the battery 34 with an extant power source for recharging, as needed. The device 10 is also operable directly from an external power source by means of interconnection with the electrical port 36 independent of the battery 34. The use of the battery 34 is thus optional.

A start button 38 is disposed in circuit with the motor 26, said start button 38 operationally controlling the motor 26. A plurality of mounting tabs 40 is disposed circumferentially around the anterior face 22, each of said plurality of mounting tabs 40 configured to releasably attach the housing 20 to an extant engine 70 proximal an extant crank axle 72 there disposed; wherein the housing 20 releasably interconnects with the extant engine 70 and the socket 30 releasably receives the extant crank axle 72 disposed upon the engine 70, whereby depression of the start button 38 activates the motor 26 and torque is transferred from the motor 26 to the crank axle 72, said torque transferred by rotation of the socket 30, and the engine 70 is started thereby.

The present device 10 enables the application of torque directly to the crank axle 72 without the need of a countering opposing force to maintain the device in place. The force is distributed through the housing 20 directly upon the engine 70. The torque, therefore, is internally distributed to the engine 70 by means of the housing 20 releasably connected to the engine 70. There is, therefore, little risk of the device 10 careening in opposition to the torque applied to the crank axle 72, as may occur with other handheld devices used for a similar purpose.

It should be noted that the device 10 is considered usable in conjunction with a starter rope, and is not devised to mutually exclude such starting devices. Rather, the present device 10 is applicable to the engine 70 irrespective of such a starter rope.

What is claimed is:

1. A removable torque transfer starter for engine comprising:

a housing;

an electric motor disposed within the housing;

a ratchet assembly disposed in the housing in operational communication with the motor;

a socket rotatably disposed anteriorly upon the ratchet assembly;

a power source in electrical communication with the motor; and a start button disposed in circuit with the electric motor;

wherein the housing releasably interconnects with an extant internal combustion engine and the socket releasably receives an extant crank axle disposed upon the engine, whereby depression of the start button activates the motor and torque is transferred to the crank axle, and the engine is started thereby.

2. The removable torque transfer starter for engine of claim 1 wherein the housing further comprises:

an anterior face disposed to contact and releasably connect to an extant engine proximal to an extant crank axle; and a posterior face.

3. The removable torque transfer starter for engine of claim 2 wherein the housing releasably attaches to an extant engine by means of a plurality to mounting tabs configured to releasably attach to said engine and fasten the anterior face in contact with said engine, the extant crank axle disposed within the socket.

4. The removable torque transfer starter for engine of claim 3 wherein the power source is a battery.

5. The removable torque transfer starter for engine of claim 3 wherein a electrical port is disposed in circuit with the power source, said electrical port configured to releasably interconnect a battery with an extant power source for recharging of said battery and for operation of the device independent of the battery.

6. The removable torque transfer starter for engine of claim 3 wherein the housing is cylindrical.

7. A removable torque transfer starter for engine comprising:

a housing having an anterior face and a posterior face;

an electric motor disposed within the housing;

a ratchet assembly disposed in the housing in operational communication with the motor, the ratchet assembly disposed proximal the anterior face;

a socket rotatably disposed anteriorly upon the ratchet assembly, said socket centrally obtruded within the anterior face;

a bearing volubly disposed in contact with the socket;

a battery in electrical communication with the motor;

a electrical port disposed in circuit with the battery and the motor, said electrical port configured upon the posterior face to releasably interconnect the battery with an extant power source for recharging the battery and for use of the device independent of the battery;

a start button disposed in circuit with the electric motor; and a plurality of mounting tabs disposed perimetrically around the anterior face, each of said plurality of mounting tabs configured to releasably attach the housing to an extant engine proximal an extant crank axle there disposed;

wherein the housing releasably interconnects with the extant engine and the socket releasably receives the extant crank axle disposed upon the engine, whereby depression of the start button activates the motor and torque is transferred to the crank axle by means of the ratchet assembly and rotation of the socket, and the engine is started thereby.

8. The removable torque transfer starter for engine of claim 7 wherein the housing is cylindrical.

* * * * *